US007513394B2

(12) United States Patent
Bone

(10) Patent No.: US 7,513,394 B2
(45) Date of Patent: Apr. 7, 2009

(54) CONTAINER COMPRISING A VALVE AND A DISPENSING SPOUT

(76) Inventor: Paul Anthony Bone, 7 Argyle Road, Newport, Isle of Wight (GB) PO30 5SB ( * ) Notice: Subject to any disclaimer, the term of this patent is extended or adjusted under 35 U.S.C. 154(b) by 613 days.

(21) Appl. No.: 10/526,135

(22) PCT Filed: Aug. 21, 2003

(86) PCT No.: PCT/GB03/03663

§ 371 (c)(1),
(2), (4) Date: Feb. 28, 2005

(87) PCT Pub. No.: WO2004/020298

PCT Pub. Date: Mar. 11, 2004

(65) Prior Publication Data

US 2006/0071039 A1 Apr. 6, 2006

(30) Foreign Application Priority Data

Aug. 31, 2002 (GB) ..... 0220296.8

(51) Int. Cl.
*B67D 3/00* (2006.01)

(52) U.S. Cl. ..... 222/481.5; 222/465.1

(58) Field of Classification Search ..... 222/481.5, 222/510, 482, 526–530, 538, 539, 424.5, 222/434, 442, 443, 450, 505, 387–389, 536, 222/537, 475, 441, 567, 465.1, 466–474; 215/263, 265; 239/387–389
See application file for complete search history.

(56) References Cited

U.S. PATENT DOCUMENTS

| | | | | | |
|---|---|---|---|---|---|
| 4,125,207 | A | * | 11/1978 | Ernst et al. | 222/130 |
| 4,236,655 | A | * | 12/1980 | Humphries | 222/465.1 |
| 5,277,343 | A | * | 1/1994 | Parsonage | 222/484 |
| 5,360,127 | A | * | 11/1994 | Barriac et al. | 215/263 |
| 5,667,101 | A | * | 9/1997 | Barrash et al. | 222/92 |
| 6,036,061 | A | * | 3/2000 | O'Donnell | 222/539 |
| 6,045,013 | A | * | 4/2000 | Yang | 222/510 |

FOREIGN PATENT DOCUMENTS

| | | | |
|---|---|---|---|
| GB | 2306151 | * | 4/1997 |
| GB | 2316858 | * | 3/1998 |
| GB | 0974525 | * | 1/2000 |

* cited by examiner

*Primary Examiner*—Lien T Ngo

(57) ABSTRACT

A container in the form of a petrol can (10, 100) comprises a body (11; 200, 201; 300, 301) having an inlet (30; 208; 309) and an outlet (20), a valve (39, 40, 45, 51) to control liquid flow through the outlet, and an actuator (19) controlling valve movement and operable at the exterior of the body. The body defines a sealed enclosure when the inlet is closed and the actuator (19) is in its non-operative position. A dispensing spout (27; 101; 206; 306) is non-removably attached at the outlet, and if this is flexible it can be flex so that part thereof is lockingly stored in a channel (25; 207; 307) of the body when the spout is not in use. The body can be in one-piece and define rear and top handles, or can have a inner part (200; 201) to which is secured an outer body part (300; 301) which defines said handles.

17 Claims, 12 Drawing Sheets

CONTAINER COMPRISING A VALVE AND A DISPENSING SPOUT

Figure 1:
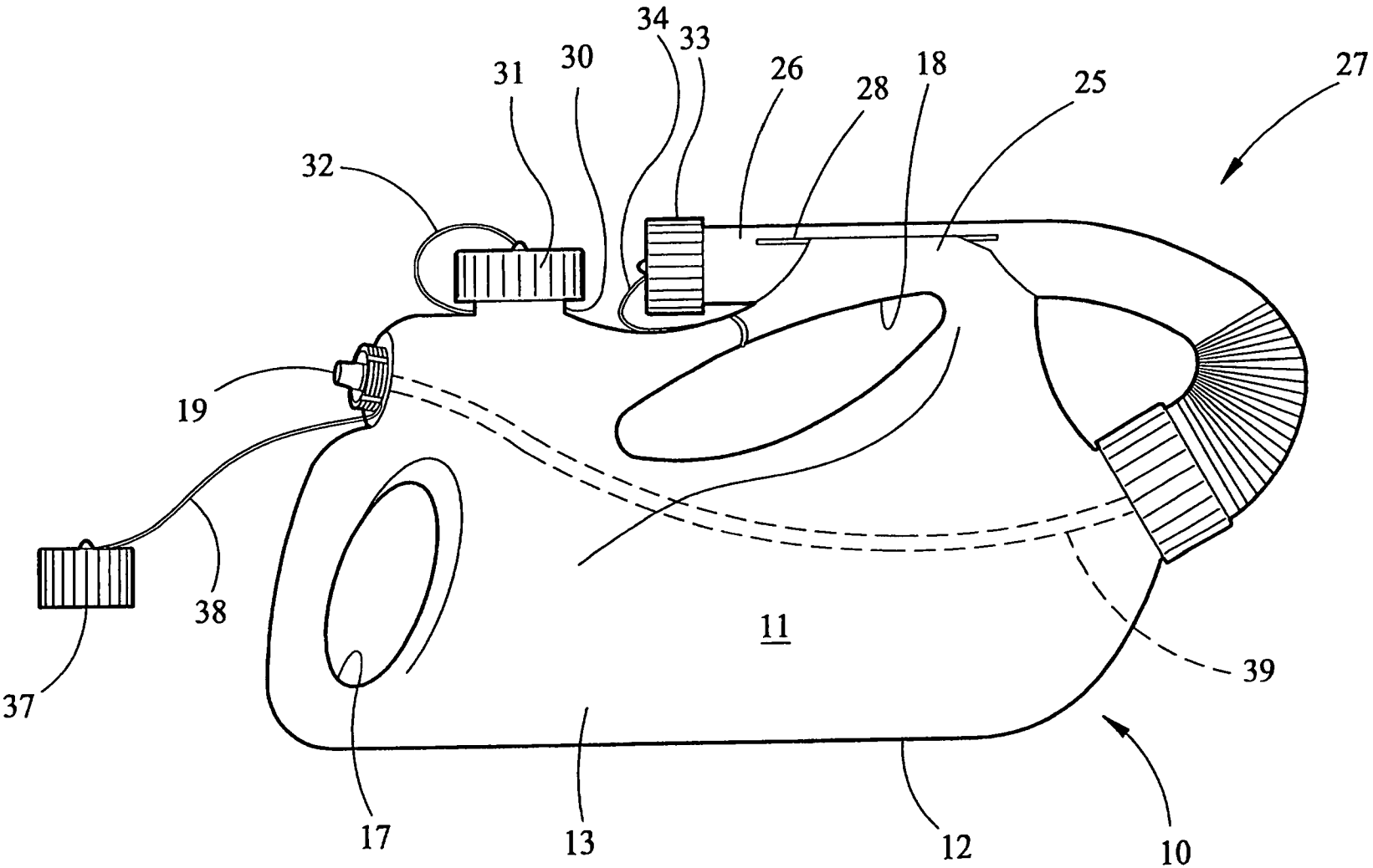
Figure 2:
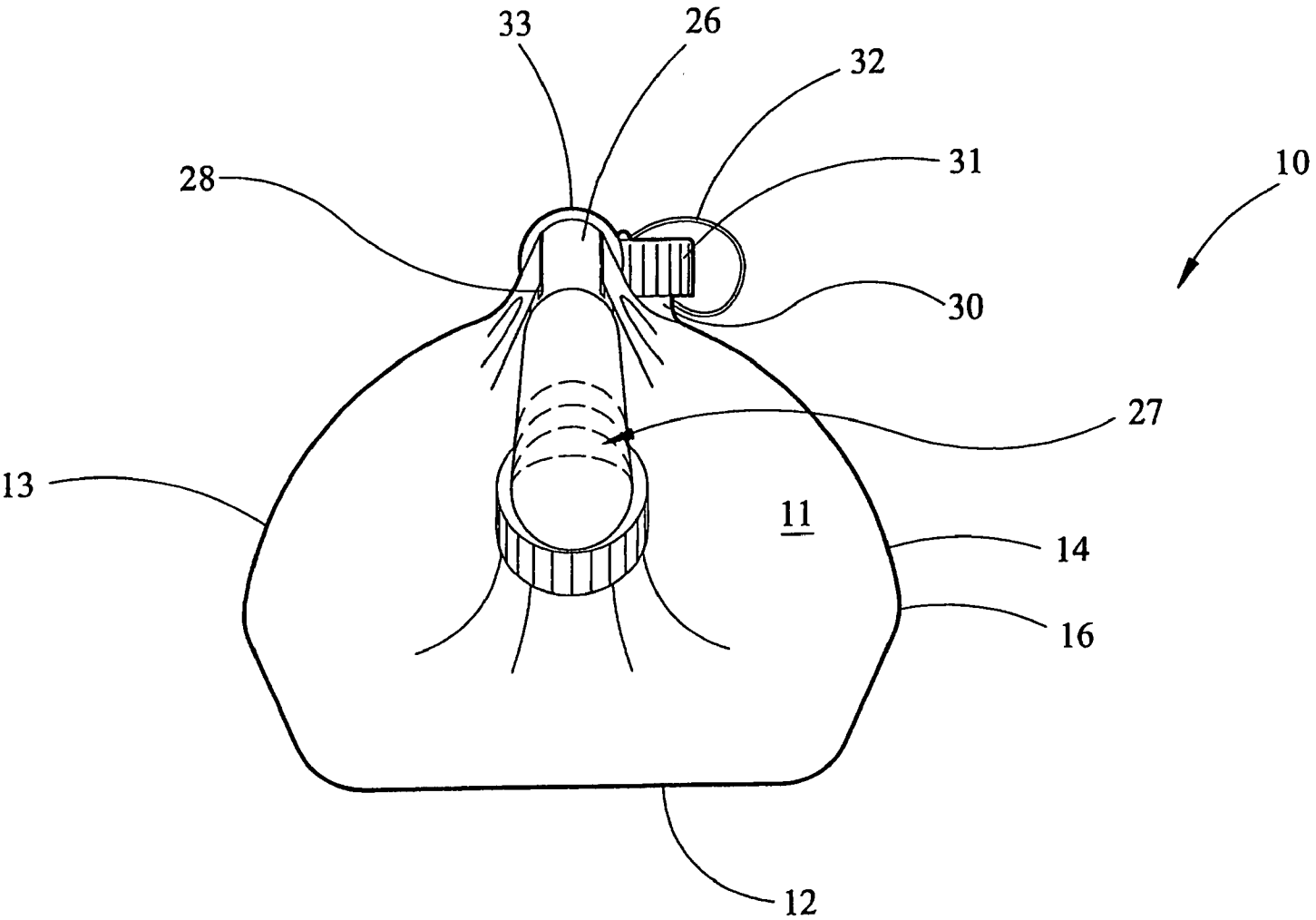

This invention relates to a container, particularly for liquid fuel such as petrol.

Presently known petrol cans suffer from several disadvantages. One such disadvantage is that in tipping up the can to dispense petrol therefrom it becomes difficult to control the outflow of the petrol. Another disadvantage is that as the spout is removably attachable to the can body, it can become lost and additionally if the seal between the spout and the can wears as the spout is engaged and released over a period of time, there will be leakage of petrol upon pouring from the can.

An object of the invention is to provide a container in which one or more of the above-mentioned disadvantages are overcome or at least minimised.

According to a first aspect of the invention there is provided a container for storing liquid and/or dispensing liquid therefrom, in use, the container having a body with an inlet for the entry of liquid thereinto and an outlet for dispensing liquid therefrom, and a valve associated with the outlet to control the flow of liquid therethrough, the valve having a movable valve member, movement of which is controlled by an actuator operable at the exterior of the body, the body defining a sealed enclosure when the inlet is closed and said actuator is in its non-operative position.

In said non-operative position, the actuator seals with the body. Preferably the actuator seals with a housing which is itself sealing attached to the body at an opening in a wall thereof. Desirably the housing contains biasing means to bias the actuator to its non-operative position. Conveniently the valve member seals with a valve seat at said outlet when the actuator is in its non-operative position.

According to a second aspect of the invention there is provided a container for storing liquid and/or dispensing liquid therefrom, in use, the container comprising a body with an inlet for the entry of liquid thereinto and an outlet for dispensing liquid therefrom, a dispensing spout non-removably attached to the body at said outlet, and a valve associated with said outlet to control the flow of liquid therethrough into said spout, the valve having a movable valve member, movement of which is controlled by an actuator operable at the exterior of the body.

Preferably said dispensing spout at one of its ends is screw-threadedly engaged with said body, and desirably locking means are provided between the spout and said body to lock the spout non-removably to the body, preferably when said end of the spout is fully screw-threadedly engaged with the body. Conveniently the screw-threads of the body which are complementary to the screw-threads of the spout are provided on the exterior of a boss of the body arranged around said outlet, and desirably when the spout is fully engaged with said body, an annular sealing ring of said spout sealing engages in a complementary annular groove in an outer end surface of said boss.

Figure 5:
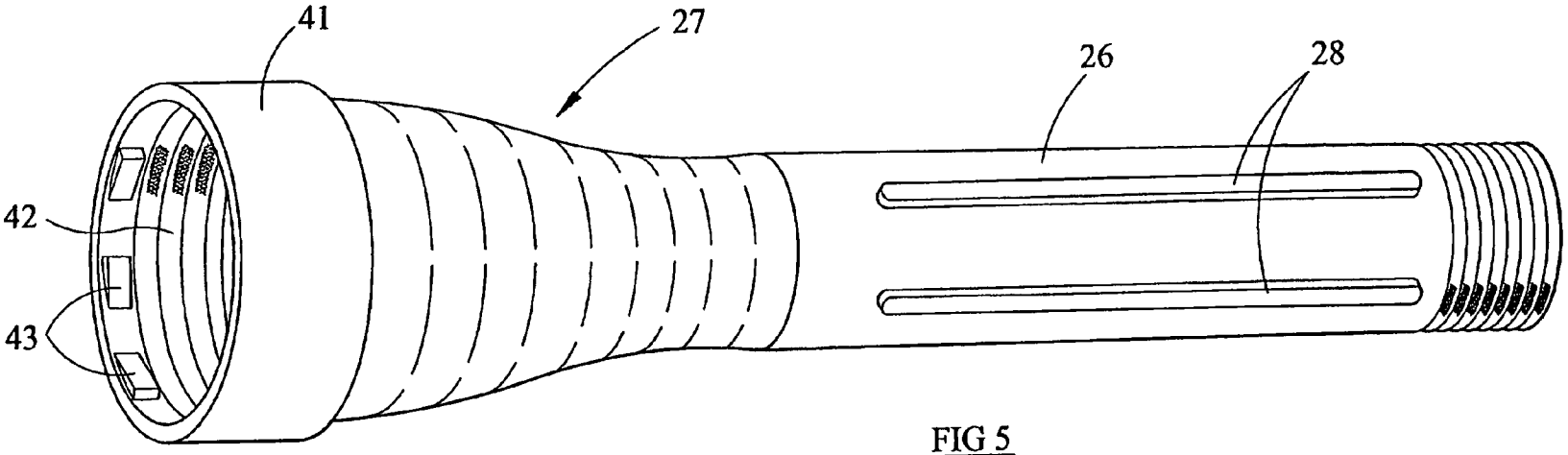
Figure 7:
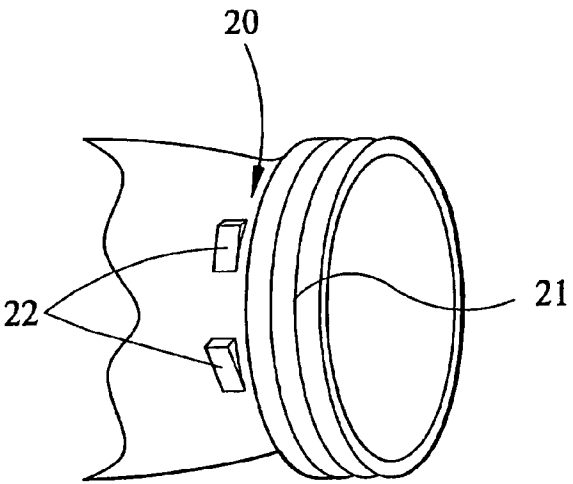
Figure 6:
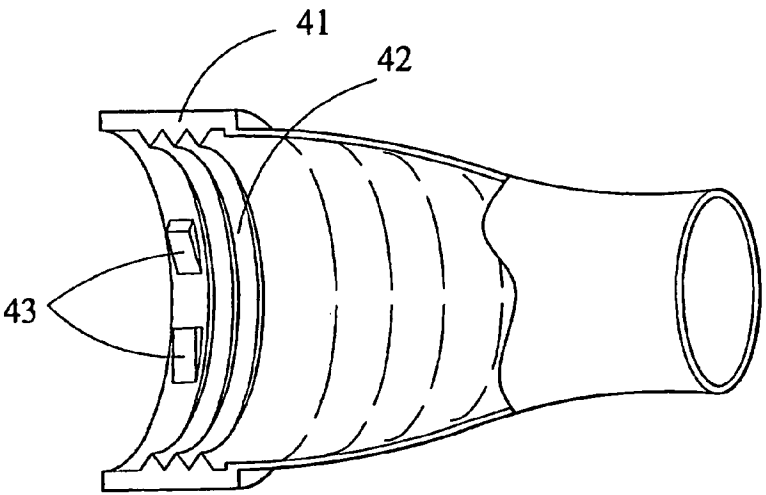
Figure 8:
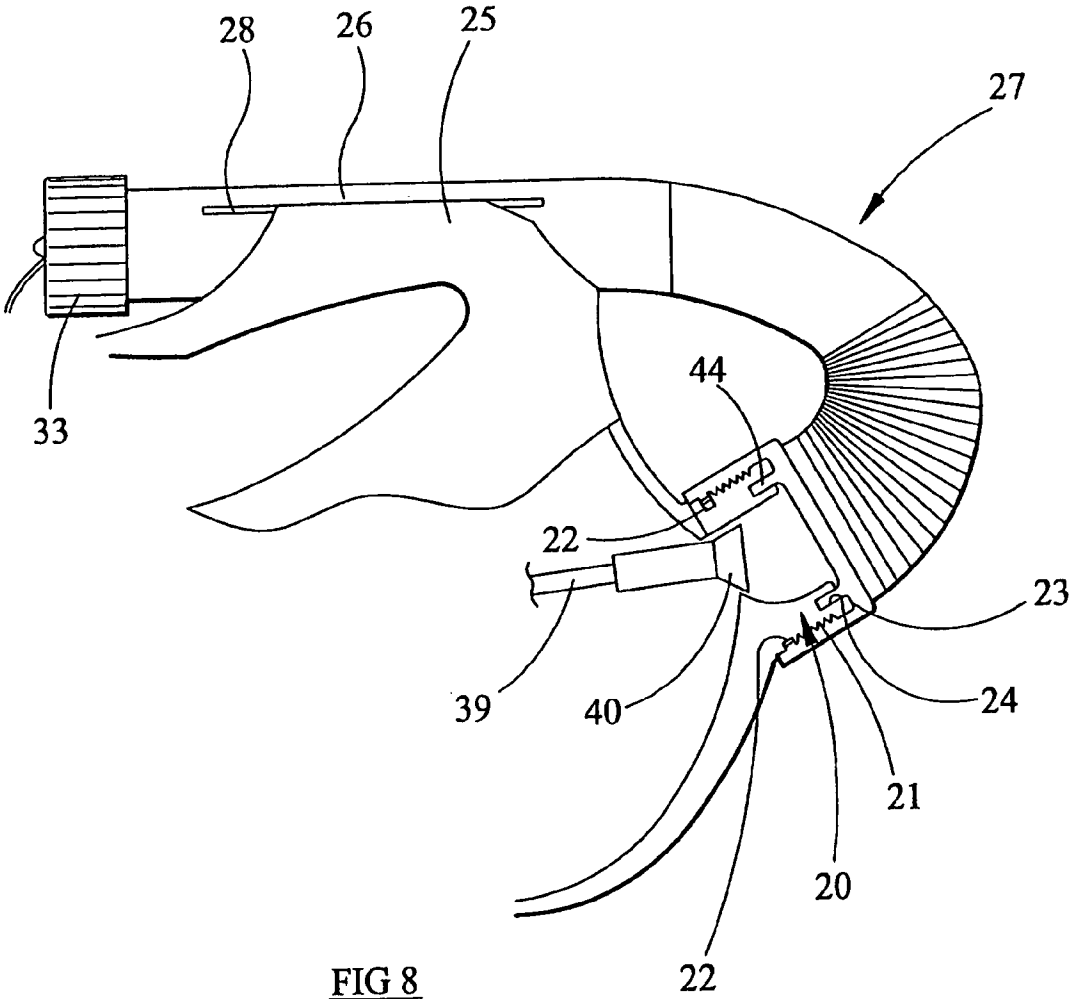
Figure 9:
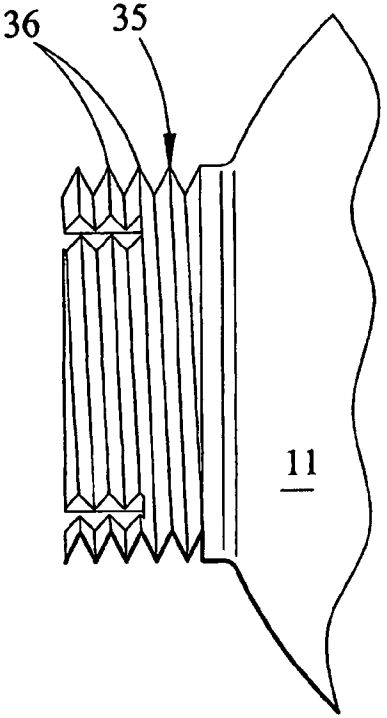
Figure 12:
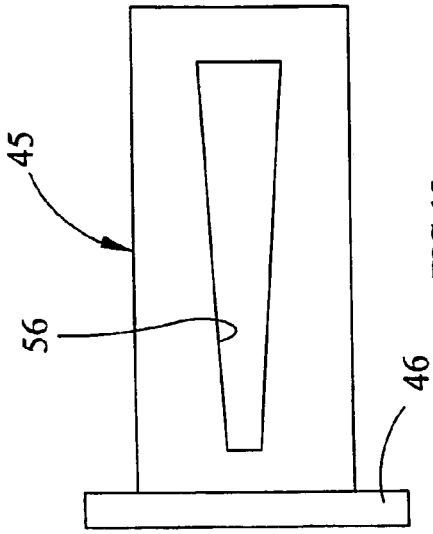
Figure 11:
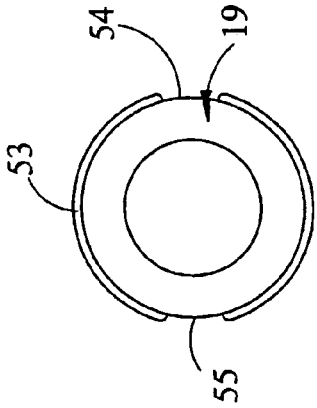
Figure 10:
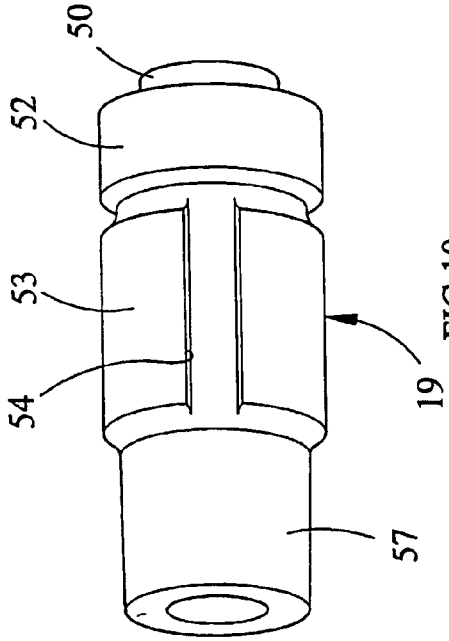
Figure 13:
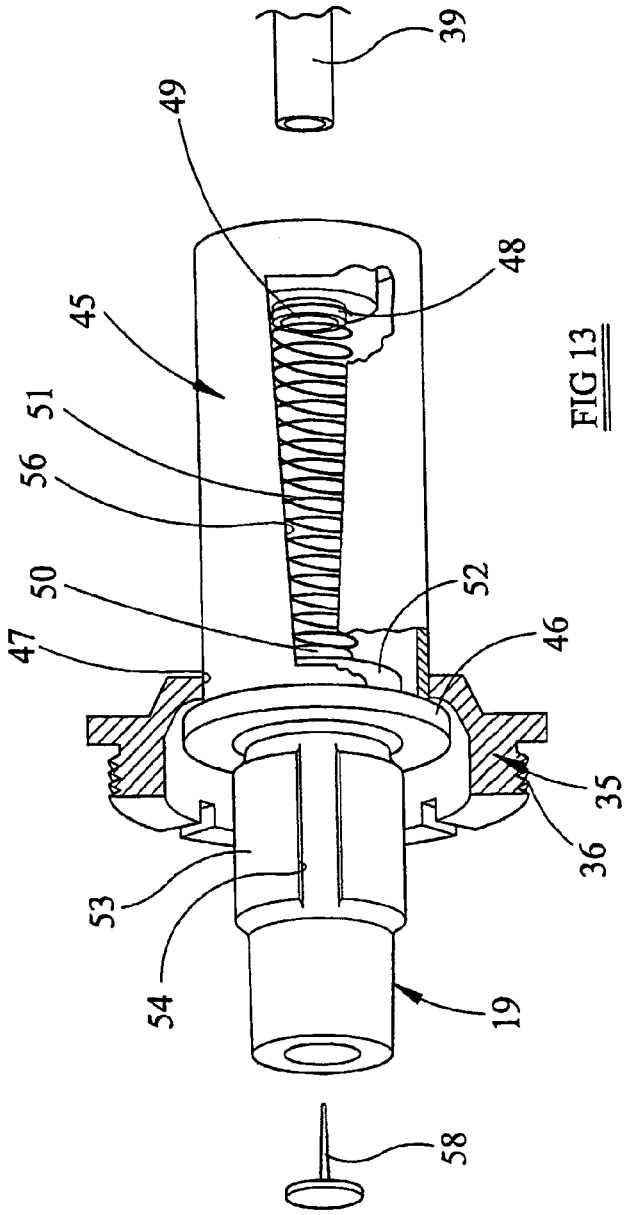
Figure 17:
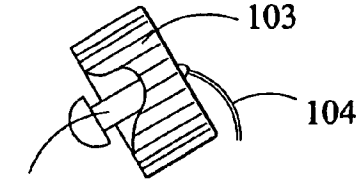
Figure 16:
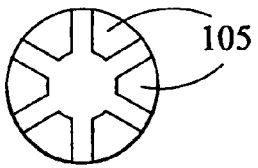
Figure 15:
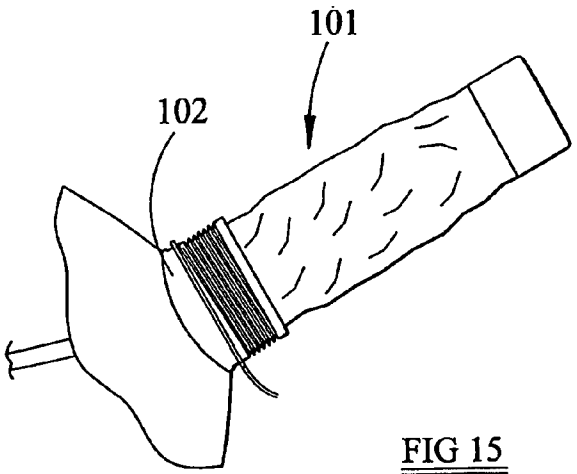
Figure 14:
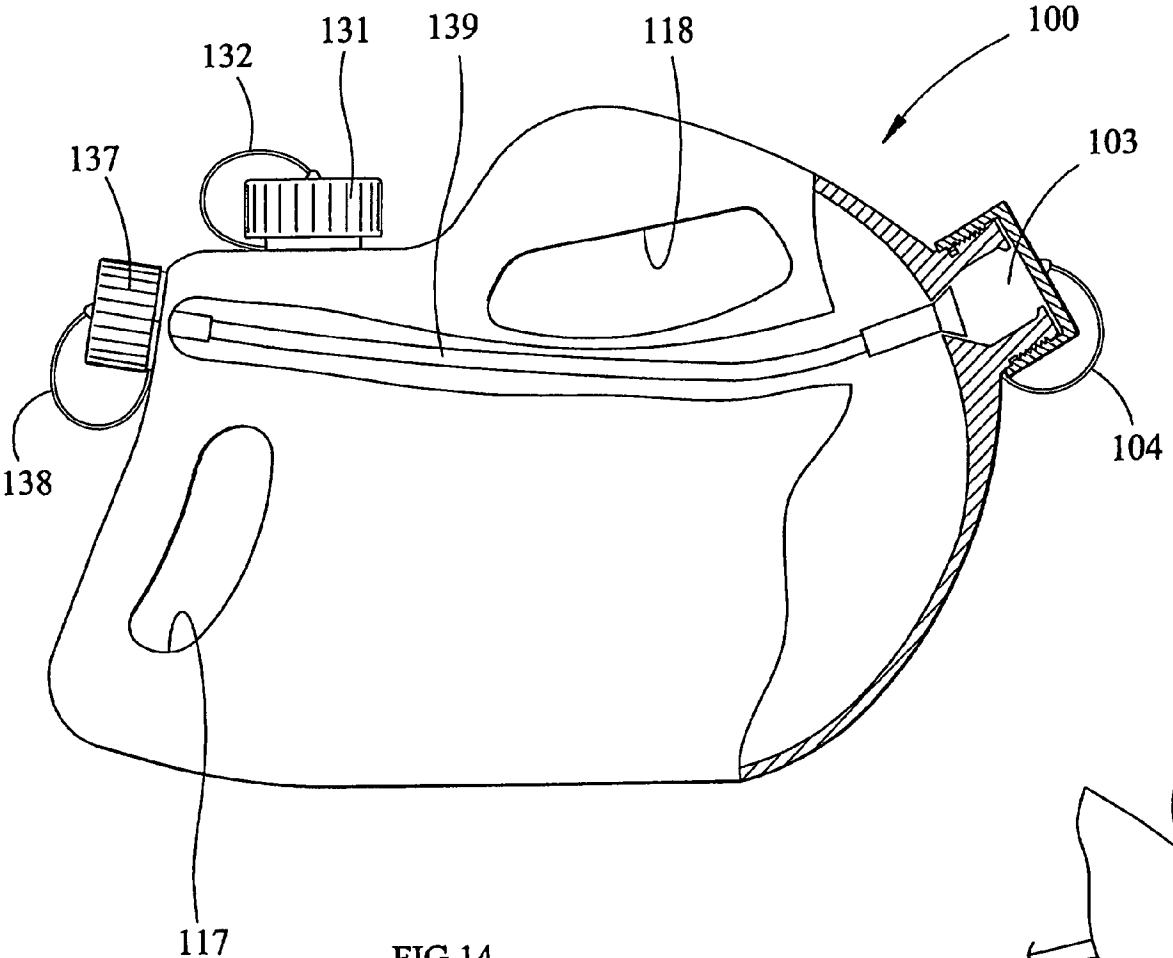
Figure 18:
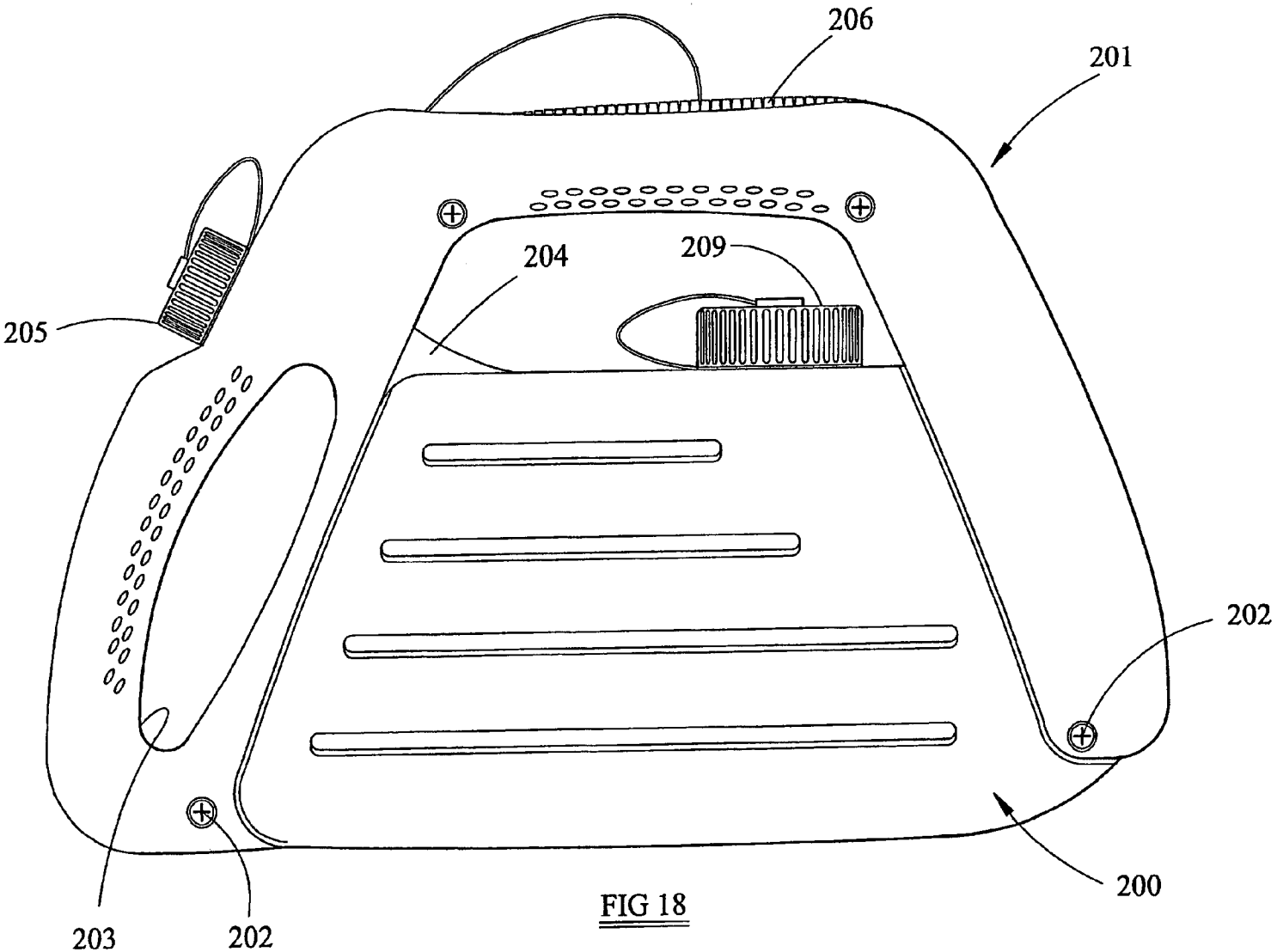
Figure 20:
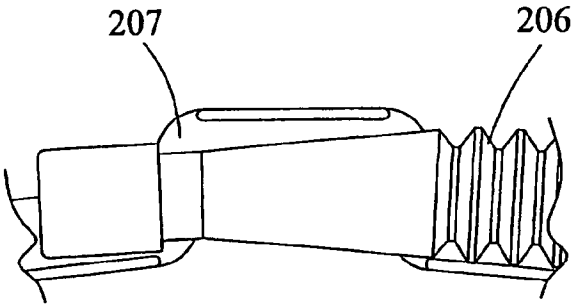
Figure 21:
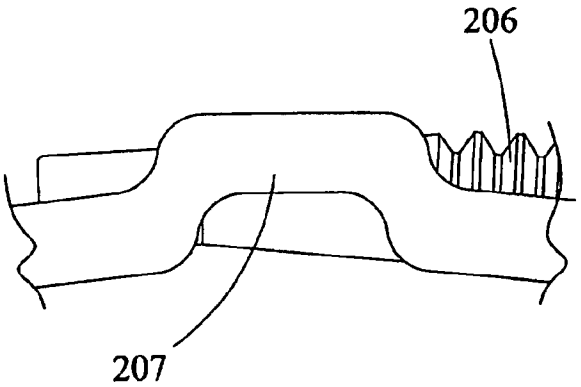
Figure 19:
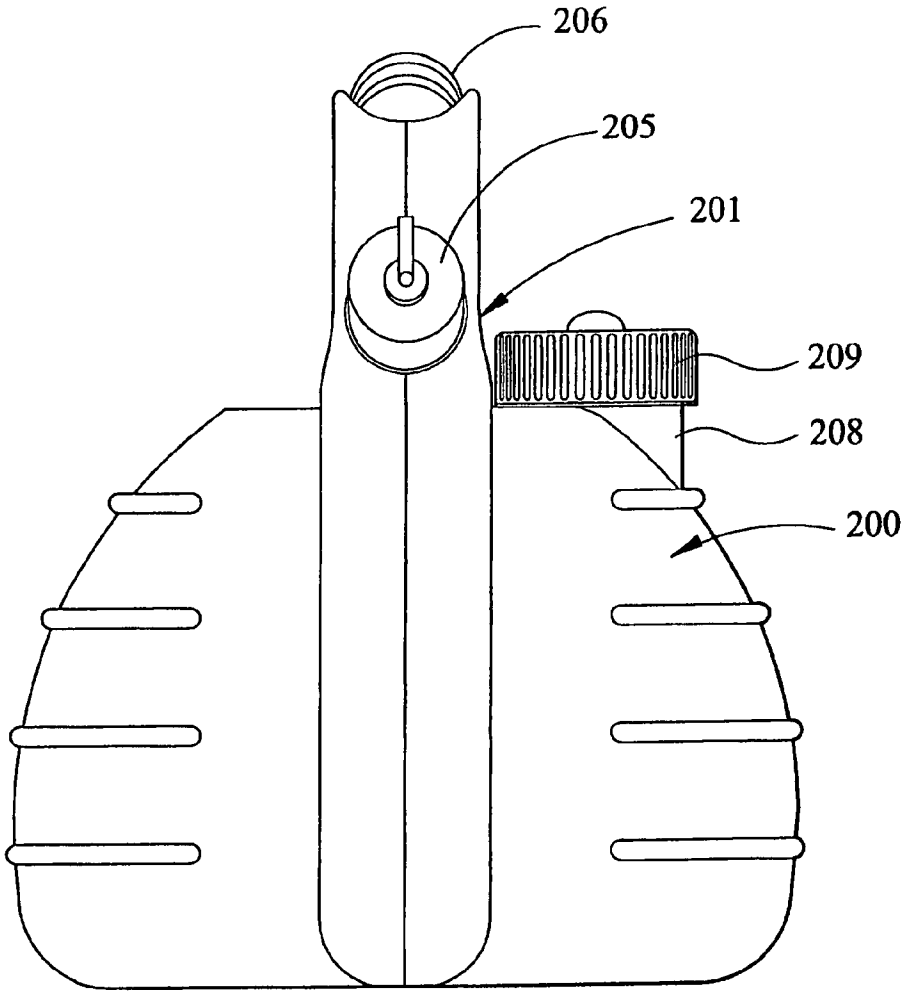
Figure 22:
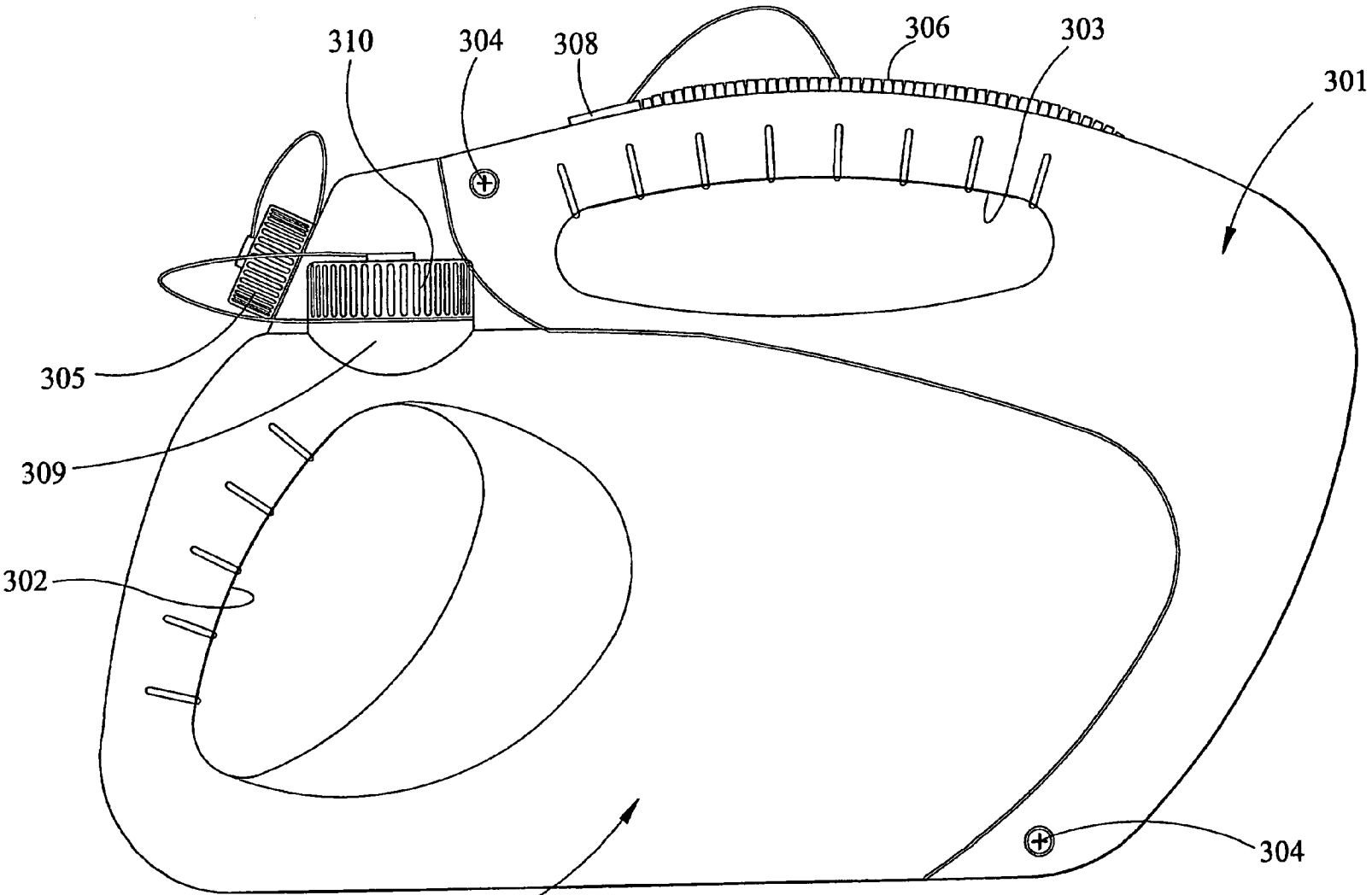
Figure 24:
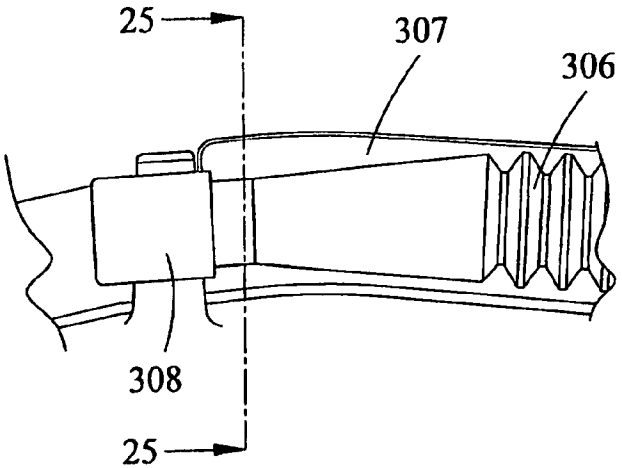
Figure 25:
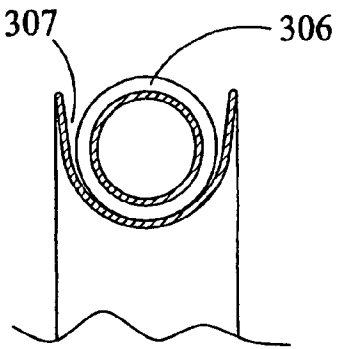
Figure 23:
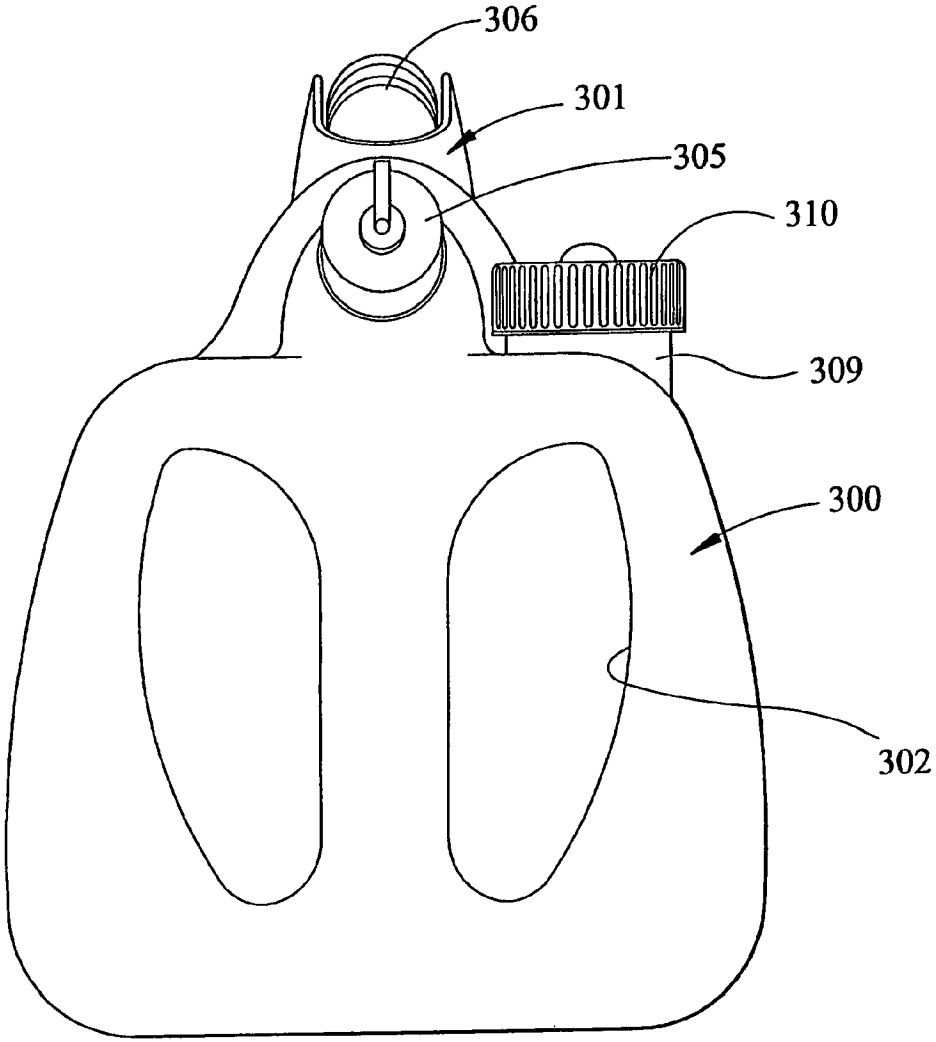

The invention will now be described, by way of example, with reference to the accompanying drawings, in which:

FIGS. 1 to 4 are respectively a side view, a front view, a rear view and a top plan view of a container of the invention, FIG. 5 is a side perspective view of a spout of the container of FIGS. 1 to 4, FIG. 6 is a fragmentary cut-away view showing a detail of locking means at one end of the spout, FIG. 7 is a fragmentary view of part of the container body at an outlet therefrom, showing a detail of locking means, FIG. 8 is a schematic, part-sectional fragmentary view of how the spout is secured to the container body and how a flexible part thereof can be locked to the body in its inoperative state, FIG. 9 is a fragmentary view of a surround on an external surface of the container body in which an opening for a push-button is provided, FIGS. 10 and 11 are respectively a side view and an end view of the push-button, FIG. 12 is a side view of a housing which is secured in the body at said opening, FIG. 13 is a part-sectional fragmentary view showing the push-button and the housing assembled together at said opening, FIG. 14 is a schematic, interior side view of a second embodiment of a container of the invention, FIG. 15 is a schematic side view of a collapsible spout of the container of FIG. 14, FIG. 16 shows an end of the spout of FIG. 14, FIG. 17 is a cut-away side view of a cap for extending the collapsed spout, FIGS. 18 and 19 are respectively a side view and a rear view of a third embodiment of a container of the invention, FIGS. 20 and 21 are respectively an inner and an outer fragmentary side view of how a spout of the container of FIGS. 18 and 19 is disposed in its inoperative state, FIGS. 22 and 23 are respectively a side view and a rear view of a fourth embodiment of a container of the invention, FIG. 24 is a fragmentary top plan view of how a spout of the container of FIGS. 22 and 23 is disposed in its inoperative state, and FIG. 25 is a cross-sectional view on the line 25-25 of FIG. 24.

A container of the invention, as shown complete in a first embodiment in FIGS. 1 to 4 and a second embodiment in FIG. 14, is in the form of a petrol can referred to generally by the numeral 10 for the first embodiment and 100 for the second embodiment. It will however be appreciated that the invention relates to containers in general, not only for liquid fuel, although it is in respect of liquid fuel to which the invention has greatest applicability and in respect of which the container of the invention will be specifically described.

A petrol can according to each of the aspects of the invention disclosed herein incorporates a push-button operated valve arrangement for controlling outflow of liquid from the container. In this regard such arrangement is generally in the forms set out respectively in British Patents Nos. 2250734 and 2316858. However where the respective arrangements of those patent specifications have been adapted for use with a petrol can rather than with a watering can as previously described, details will be given herein. However the basic structure and operation of the operating link between the push-button and the valve member of the valve arrangement remains substantially unaltered and will not be described herein.

The first embodiment of the petrol can, denoted by the numeral 10, can be formed of metal or plastics material. If produced of plastics material, the complete body is blow moulded in one piece. As shown in FIGS. 1 to 4, the can comprises a body 11 which has a flat base 12 so that the can is stable on a flat supporting surface. Although the can may be formed in any convenient shape, it can be seen from FIGS. 1 to 4 that in this embodiment the can body is oval-like in top plan view, with respective opposite sides 13,14 extending outwardly and downwardly from the can top surface 15 to an outwardly waisted portion 16, from which the sides then extend inwardly and downwardly for a short distance to the base 12. This construction provides stability to the can.

Figure 3:
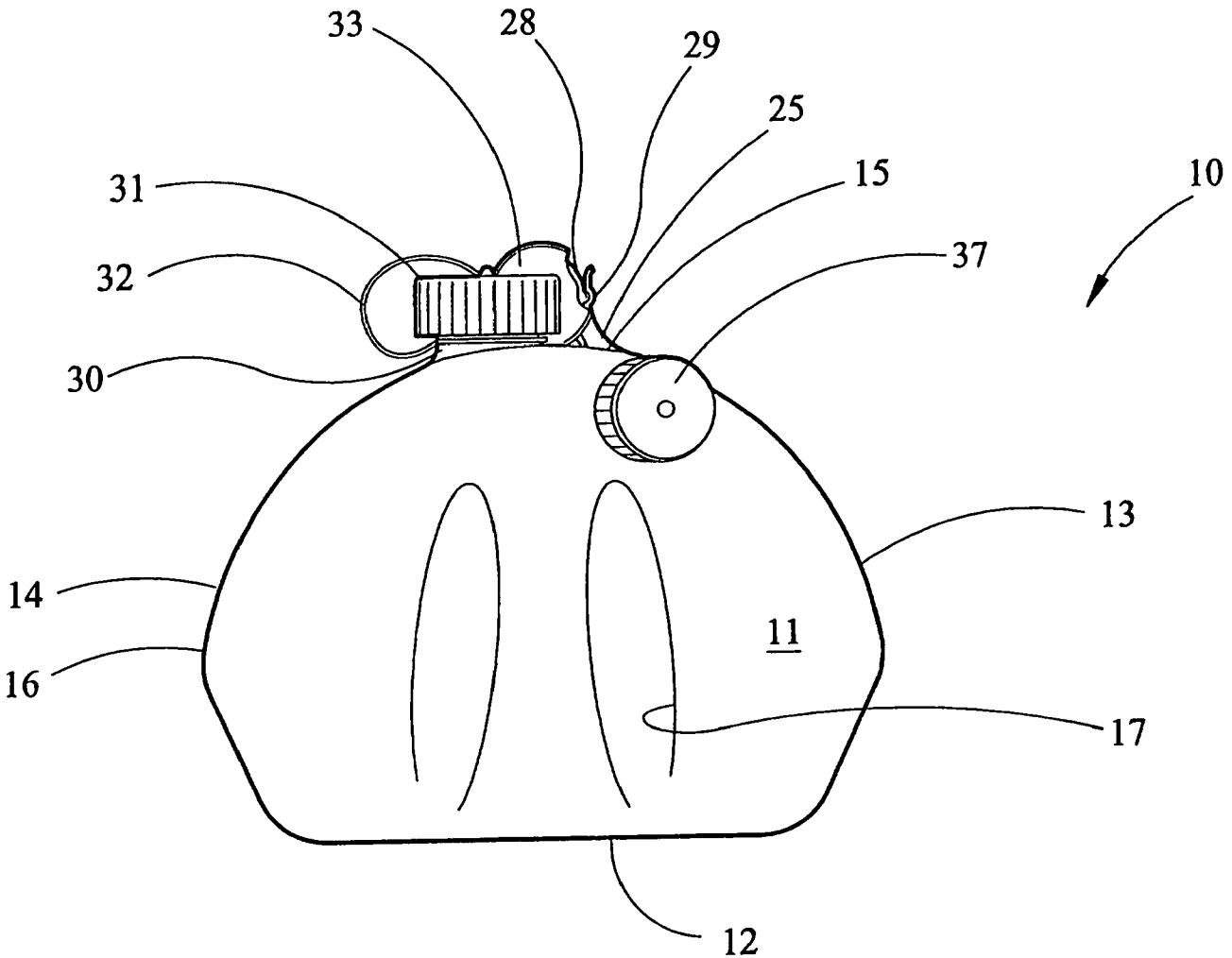
Figure 4:
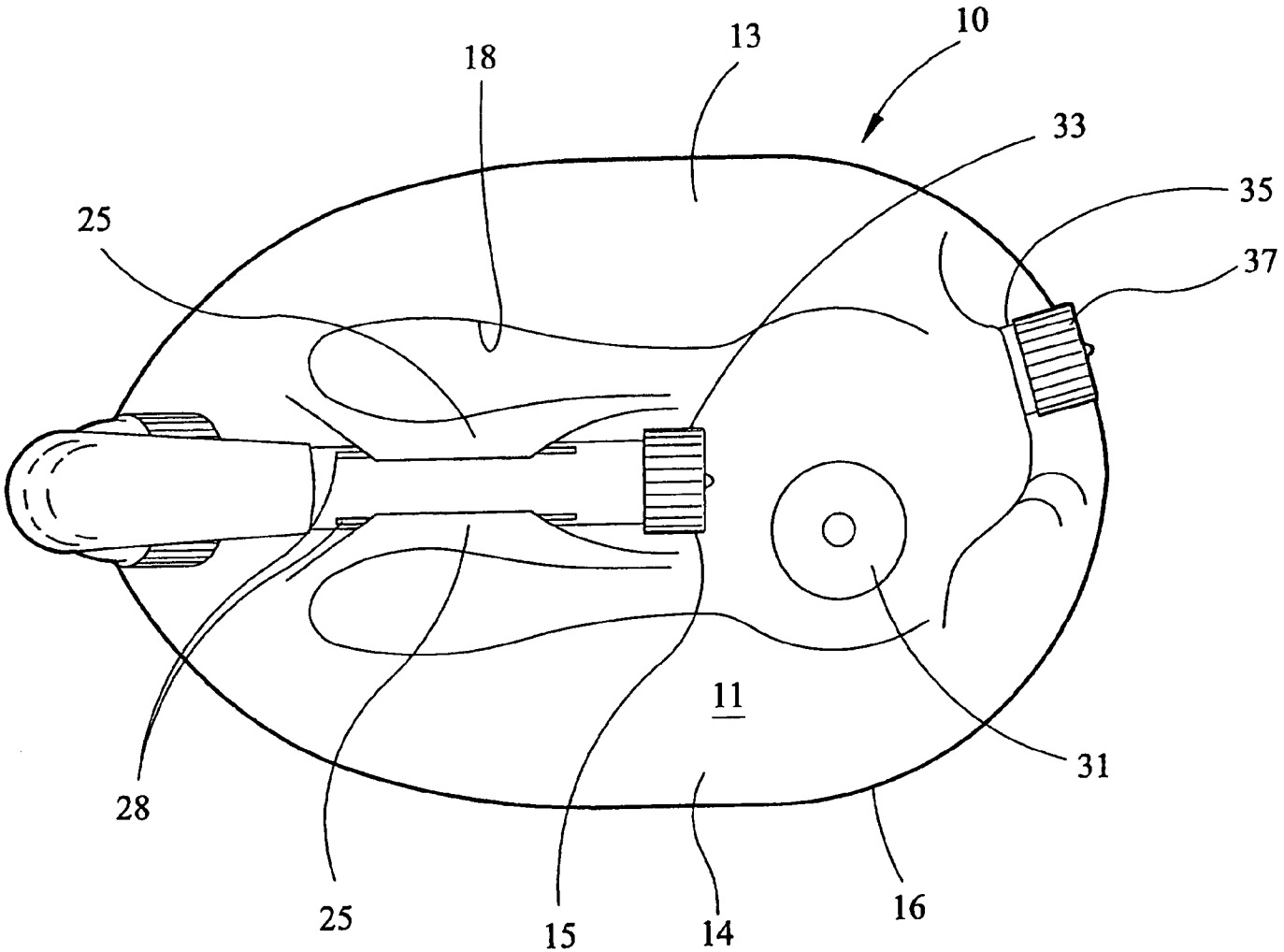

As can be seen best from FIGS. 1 and 3, the body is provided with two through apertures 17,18 respectively to receive a user's hand to grip and manipulate the can. The aperture 17 extends through the body of the can at a lower rear part thereof, it being intended that a user inserts his or her hand through this aperture with the thumb of that hand being used to operate a push-button 19 which is disposed adjacent to and just above said aperture 17. The aperture 18 is provided to allow the user's other hand to grip the can so as to facilitate the handling thereof, particularly where the can is full or near full and thus relatively heavy. This aperture 18 is disposed generally through the upper central part of the can body.

At its front, the can body is formed with an outwardly projecting spigot or boss 20 (FIG. 8) which has an external screw-thread 21, there also being formed around the exterior surface of the boss 20, at a position below the screw-thread 21, a number of spaced locking means in the form of ramp-like projections 22, for a purpose to be hereinafter described. In its axially directed annular end surface 23, the boss 20 is formed with an annular groove 24, for a purpose again to be described hereinafter.

At opposite sides of its top surface 15, is provided a pair of opposed wings 25 defining between them a channel in which a free end part 26 of a flexible spout 27 is intended to be received in an inoperative state of the spout, with longitudinal axially extending ribs 28 on the exterior surface of the part 26 engaging in respective complementary grooves 29 in the respective inner surfaces of the wings 25 so that the part 26 can be releasably locked in place in said channel in said inoperative state to provide convenient storage for this free end of the flexible spout. As will be appreciated, said end part 26 is shown stored in FIGS. 1 to 4 as well as in detail in FIG. 8.

The top of the can body is formed at a position adjacent the rear thereof with an upstanding spigot or boss 30 which is externally screw-threaded and which has an inlet opening therethrough to define a filling hole for introducing fuel into the can. As shown in FIGS. 1 to 4, this opening is intended to be closed by a cap 31 which has an internal screw-thread complementary to the external screw-thread on the boss 30 so that the cap can be screwed down tightly into sealing engagement with the body at said boss thereby to prevent outflow of fuel at said inlet opening if, for example, the can were to be inverted. It can also be seen from the drawings that the cap 31 is joined to the body by a flexible strap 32 so that this cap 31 cannot become lost. In a similar manner a cap 33 for sealing the open free end of the spout 27 is connected to the body by a flexible strap 34.

Finally in relation to the actual structure of the can body, it can be seen from FIG. 13 that the rear of the can where the push-button 19 is disposed is formed with an outwardly projecting annular flange 35 which is slightly spaced from, but surrounds, the push-button 19. This flange 35 is exteriorly threaded as at 36 for the engagement therewith of complementary thread in the interior of a cap 37 which is sized so that it can sealingly engage with the flange 35 and cover the push-button when it is in its fully extended, non-operative state, i.e. as shown in FIG. 1. This cap is joined to the body by a flexible strap 38, again ensuring that the cap cannot be lost or mislaid. As will be described hereinafter, the cap, when in place, prevents accidental pushing of the button in transit and also prevents accidental operation of the button if the can were to be dropped.

FIG. 1 shows, in phantom, the operating link 39 between the push-button 19 and the valve member 40 (FIG. 8) of the arrangement herein before referred to in relation to British Patents Nos. 2250734 and 2316858. As mentioned above, the precise structure of this link 39 is not a feature of the present invention and either of the forms disclosed in said patents respectively could be used, or alternatively the link 39 could be an adaptation of either of said earlier constructions. However it will be noted from FIG. 1 that the link is substantially straight from the push-button to the valve member 40 so that as a consequence, depression of the push-button positively pushes out the valve member so that reliable operation is ensured and that there is no danger of this shorter link sagging and thus relying on the internal liquid pressure in the can to force open the valve member. As can be seen from the drawings, the push-button is disposed at one side of the longitudinal centreline, and together with this it can also be seen that the inlet opening at the boss 30 is similarly offset relative to this centreline, but to the opposite side thereof from the push-button 19. This is to ensure that when a user inserts a conventional petrol pump nozzle into the inlet opening the end of the nozzle does not foul the link 39, since repeated fouling of this line by the pump nozzle could result in damage to the link and the possible sagging referred to above, leading to unreliable operation of the valve member by depression of the push-button. As can be seen from FIG. 8, the end of the valve member is frusto-conical and engages a valve seat at the inner end of the outlet opening in the boss 20. However for clarity a clearance is shown between the valve member 40 and its seat in FIG. 8, although this would not be present in practice so that the valve member would tightly seal onto its seat when the push-button is in its inoperative position.

Now considering FIGS. 5 to 8, it can seen that the spout 27, which, as stated, is flexible, has its one end provided with an internally threaded socket portion 41, the screw-thread being indicated at 42 and being complementary to the screw-thread 21 on the boss 20. As can be seen from FIGS. 5, 6 and 8, this screw-thread does not extend to the open outer end of the socket portion 41, but terminates short thereof. Adjacent this open end, the internal surface of the portion 41 is provided therearound with a series of spaced ramp-like locking projections 43 substantially equivalent to the projections 22 on the external surface of the boss 20. These projections 22 and 43 are arranged so that on assembly of the can during manufacture the socket portion 41 is engaged on the boss 20 and screwed-up to the position shown in FIG. 8. As the portion 41 is screwed onto the boss 20, the projections 43 come into contact with the projections 22 and, due to the ramp-shapes of these, the projections 43 ride over the projections 22 in the screwing-up direction. However once the portion 41 has been fully screwed onto the boss 20, the respective raised ends of the ramp-like projections 43 are in juxtaposition with the respective corresponding raised ends of the ramp-like projections 22 on the boss 20 such that an attempt to turn the socket portion 41 in a direction such as to unscrew it from the boss 20, results in the respective raised ends of the projections 43 engaging the respective raised ends of the projections 22 such that disengagement cannot take place so that by these locking means formed by the projections 22 and 43, the spout is locked to the can body and can only be removed therefrom by force, since it is intended that once the spout is thus fitted and locked in place by the manufacturer, it should not thereafter be separated from the can body. It can also be appreciated from FIG. 8 that when the socket portion 41 is fully screwed onto the boss 20, a concentric annular flange 44 projecting outwardly from the inner surface of the socket portion 41 is tightly sealingly received in the annular groove 24 further to resist any leakage between the can body and the spout at its area of attachment. Thus not only is there a tight seal between the portion 41 and the boss 20 at the screw-threads, there is also a tight seal between the flange 44 and the groove 24.

The spout, which is of clear/translucent plastics material, is flexible and can thus be twisted, as shown in FIG. 8, so that its straight cylindrical end part 26 can be engaged between the wings 25, as described, with its ribs 28 being arranged to click into the complementary grooves 29 in the wings 25 on the can body. This enables the spout to be firmly and conveniently stored when not required for use. As mentioned, the permanent attachment of the spout to the can body is a safety feature in that the spout cannot be lost so that there is no temptation for a user to try to pour liquid from the can without a spout, such action invariably resulting in spillage of the liquid dispensed. Clearly with petrol, paraffin or the like, this represents a considerable safety risk. It will also be noted that the valve member 40 is within part of the can body itself and is not disposed at the end of the spout, as is the arrangement when the valve member is used in a watering can as described in the two above-mentioned British patents. Accordingly with this present invention the valve member is protected and is arranged so as to prevent damage thereto, so that a controllable flow of petrol, or other fuel from the can, can easily be obtained by use of the push-button arrangement. It will be appreciated that instead of ribs on the spout co-operating with complementary grooves on the wings 25, the reverse arrangement could be employed, i.e. with the ribs on the internal surfaces respectively of the wings. During manufacture the push-button operating link 39 with the valve member 40 on its one end is firstly fed through the outlet opening into the interior of the can body until the leading end of the link can be engaged with a housing 45 shown in FIG. 13 and the valve member 40 reaches its seat shown in FIG. 8. Once the operating link 39 has been securely engaged at the housing 45 so as to be attached to the push-button 19, so that the link 39 is disposed as shown in phantom in FIG. 1, the socket portion 41 is then screwed onto the boss 20 as described. In one arrangement the push-button 19 is engaged with the housing 45 by insertion into its left-hand end as viewed in FIG. 13 with the free end of the link 39 shown in FIG. 13 passing through the housing and being engaged in the end of the push-button 19 received in the housing 45.

Considering now FIGS. 9 to 13, it can be seen that the housing 45 is of generally hollow cylindrical form having an external annular collar 46 at its one end. The housing 45 is tightly sealingly received through a circular opening 47 in the rear wall of the can body, around which opening 47 the annular flange 35 is disposed, as shown best in FIG. 13. The housing 45 is preferably secured in place at said opening 47 by adhesive or other means such that its collar 46 is positioned against or just outward of the wall of the can body at which the opening 47 is disposed, so that the collar 46 is disposed within the interior space defined by the annular flange 35. The end of the housing 45 at which the collar 46 is disposed is formed with a circular opening to allow the inwards and outwards sliding of the push-button 19 relative to the fixed housing 45, whilst the opposite end of the housing 45 is formed with an inwardly directed boss 48 through which a circular bore 49 extends for reception of the free end of the operating link 39 such that, as described on assembly, the link 39 can be pushed through the bore 49 and within the housing 45 so as to engage in an opening in the inner end of the push-button 19 so as securely to attach the link to the push-button. This inner end of the button 19 has an outwardly extending boss 50 in which is disposed the above-mentioned hole for reception of the link end 39. The boss 50 and the boss 48 act as respective location points for the opposite ends of a coiled compression spring 51 received within the housing 45 as shown in FIG. 13. This spring accordingly biases the push-button to its outward, non-operative position shown in FIG. 13, the force on the button drawing the link 39 taut as shown in FIG. 1.

The external shape of the push-button 19 is as shown in FIGS. 10, 11 and 13, this being generally cylindrical but varying radially along its axial length. Accordingly next to the boss 50 is a cylindrical portion 52 which has a diameter equivalent to the diameter of the opening through the collar 46, so that, when the push-button is in its FIG. 13 position, this portion 52 tightly engages and seals with said housing 45 at the collar 46. Although not shown as such in FIG. 13, it could also be arranged that the internal diameter of the housing 45 is the same as the internal diameter of the opening through the collar 46, so that there is sealing not only between the part of the portion 52 within the collar, but also for the part of the portion 52 which projects into the housing 45. However whatever the arrangement, there will be provided a tight seal between the push-button 19 and the housing 45 so as to prevent leakage of liquid from the can body at the opening in the collar and also at the opening 47. The radius of the push-button 19 reduces at the left-hand side of the cylindrical portion 52, as viewed in FIG. 10, and next to this reduced radius portion is a further cylindrical portion 53 which has a diameter substantially equivalent to that of the cylindrical portion 52 so that when the button is pushed into the housing 45 this portion 53, which is longer axially than the portion 52, acts to guide the button into the housing 45 and prevent misalignment, thereby ensuring pure axial sliding. However to allow venting of the petrol can when the button is moved from its non-operative state shown in FIG. 13 to its operative state where the valve member is moved off its seat to allow dispensing of liquid from the can, the further portion 53 is provided with a pair of diametrically opposite longitudinal grooves 54,55 respectively in its external surface, each groove extending along the whole length of the portion 53. Accordingly when the button is pushed in and the portion 53 seals with the housing 45, there is nevertheless defined two airflow passages at the grooves 54 and 55 respectively so that ambient air vents the can by flowing into the housing 45 and thence into the interior of the can to replace the dispensed liquid through an opening 56 in the housing 45. This opening 56 is shown in detail in FIG. 12, and may conveniently be generally rectangular, but with sloping sides. The disposition of the housing 45 in the can body would generally be such that this opening is directed downwardly so that liquid will not remain in the housing 45 when the level of liquid in the can interior falls below the level of the housing 45. In other words the housing 45 would be disposed at 90° to the orientation shown in FIG. 13 in a direction to bring the opening 56 to face the bottom of the housing. Finally it can be seen that the outer end of the push-button is formed as a cylindrical portion 57 having a diameter slightly less than that of the further cylindrical portion 53, although the diameter here is not crucial in that this part never enters the housing the 45 due to the resistance of the spring 51 and its length when coiled. As shown in FIG. 13, the outer end of the push-button 19 can have an opening for reception of a peg, pin 58 or equivalent as required, and this may also form part of a fixing arrangement for securing the end of the operating link 39 to the push-button 19.

From the above it is believed that various advantageous features of the can will be apparent, these being as follows. A controllable flow of petrol, other fuel, or any other liquid is readily achievable by use of the push-button arrangement. The valve member is within the structure of the can itself rather than at the end of the spout. The spout is manufactured separately, but permanently attached to the can body during assembly. The flexible spout incorporates grooves/ribs that click into and engage with corresponding ribs/grooves at the can handle for firm fitting. The spout is made of clear plastics material for identifying whether there is fuel therein. The straight or substantially straight line followed by the link from the push-button to the valve member ensures that depressing the button pushes out the valve member, for reliable operation. The push-button is off centre, so that with or without the inlet being off centre, a user can fill the can from a petrol pump nozzle without this nozzle coming into contact with the operating link. The locking means between the can body and the spout ensures that the spout is firmly and permanently sealingly locked into place. The grooves in the exterior surface of the push-button are long enough to allow smooth depression of the button along with airflow into the can to provide venting. The button has an associated cap to cover it when not in use, thereby to prevent accidental pushing in of the button in transit and accidental spillage of petrol or other liquid contained in the can.

Finally in relation to this first embodiment, it is noted that in FIG. 9 the screw-thread 36 is interrupted by slots 59 extending inwards from the free end of the flange 35. These slots ensure that even if a user were to push in the button 19 and fully cover the outer open end of the flange 35, for example by means of the user's thumb, air would still be able to flow to the grooves 54 and 55 by passing in through the slots 59.

Another feature of this embodiment is that the angle of the valve member at its seat is less than with the watering can arrangement described in the above-mentioned British patents. Here the angle may be reduced to, for example, 45° to inhibit pulling back of the valve member into the can body. This will overcome any tendency for contraction of the can, due to temperature change, to suck the valve into the interior of the can. Finally it is mentioned that all the features of the embodiment described would function equally with a petrol can of the 'honeycomb' type.

In particular with the embodiment described, it will be noted that as shown in FIG. 1, there is provided a totally sealed enclosure in that sealing at the push-button has been specifically addressed as has sealing at the spout connection. Finally tight sealing is also provided at the inlet by virtue of the engagement of the cap 31.

The embodiment shown in FIG. 14 is very similar to that described in relation to FIGS. 1 to 13, and really only differs in relation to the nature of the spout. With this embodiment the spout is of the collapsible or crumple type being manufactured from a special plastics material. Accordingly when the spout is not in use, i.e. when dispensing of liquid from the container is not required, the part of the spout which crumples/collapses is received in the container. However it will be noted that with this spout 101 for the can 100, the spout again has a socket portion 102 which screws down to and locks onto a corresponding integrally formed as part of the can body in the same way as for the boss 20 and socket portion 41 of the previous embodiment. Thus again the spout is permanently attached to the can body after the manufacturing assembly has been completed. Similar parts of the can construction are identified by the same numerals in FIG. 14 as for those used in relation to the first embodiment, but with the prefix 100. FIG. 14 shows that with the spout 101 in its collapsed state, a cap 103 attached to the body by a strap 104, is screwed onto the socket portion 41 by means of an external screw-thread on said socket portion and an internal screw-thread in the cap. Alternatively the spout 101 could be connected to the body in some other form and the cap could screw directly onto the boss formed as an integral part of the can body. FIG. 16 shows that the outer end of the spout 101 is formed, by means of a series of cut-outs, as a plurality of teeth 105, and FIG. 17 shows that the cap 103 is formed with a central interior shaped head 106 which can be pushed into the end of the spout so as to engage the semi-hemispherical end of the head behind the teeth, so that when the cap is pulled outwardly from its FIG. 14 position, the head will engage behind the teeth and pull the spout outwardly from its crumpled/collapsed position to its fully extended position shown in FIG. 15. After use, the cap can be used to push the spout back into the can, or alternatively this can be accomplished manually. The shaping at the end of the head 106 thereby facilitates the extending of the spout, given that this can sometimes be troublesome with cans in which this use of a crumple spout is known.

Another embodiment of a container of the invention, in the form of a petrol can, is shown in FIGS. 18 to 21. This can differs from the previously described embodiments mainly in that it is made up of an inner body 200 and a protective outer body 201 extending centrally around the top, front and rear thereof to define the rear and top handle positions. The outer body is screwed to the inner body as shown at 202.

The inner body is generally trapezoidal in side view, and of similar shape in front and rear views to the can of the embodiment of FIGS. 1 to 4, but having curved rather than straight sloping sides. The main body is preferably blow moulded in plastics material. The outer body 201, which can also be of plastics material has an aperture 203 in its rear part extending along the centre of the rear surface of the can, as shown in FIG. 19, so as to provide a rear handle to receive a user's hand to grip and manipulate the can. A spigot 204 extends at an angle from the top of the body 200 through the body 201 at a position just above the aperture 203, the push-button of the previously described can embodiments being sealingly fitted at said spigot for operation as before, with a cap 205 being screw-threaded onto the spigot to prevent inadvertent push-button operation. The cap can be secured to the body 201, as shown.

The upper part of the body 201, which is parallel to the flat upper and lower surfaces of the body 200, is spaced above the flat upper surface to define an upper handle of the can, equivalent to the handle defined by opening 18 in the first embodiment of the can.

At its front part, the body 201 has a boss (not shown) of the body 200 extending therethrough, and a spout 206 is fixed thereto in the same or a similar manner as with the first embodiment described. In its inoperative state it can be stored, and preferably locked, in an upwardly open channel defined between opposite sides 207 of the upper part of the body 201, as shown in FIGS. 20 and 21. The outlet at which the spout is fitted is sealed by the valve of the push button arrangement previously described.

Finally in respect of the structure of the can, a filling opening is formed in the upper surface of the body 200 by an upstanding boss 208, which can be sealingly closed by a cap 209 connected to the body 200. As shown in FIG. 19, the boss 208 is disposed to one side of the centreline of the can so that filling of the can with a petrol pump nozzle does not foul the link operated by the push button.

Although the function and operation of the can is the same as with the previous embodiments described, the protective body 201 is advantageous in not only better protecting the spout but also in improving the aesthetics of the can. Moreover it provides a convenient way of providing the two can handles. Instead of the body 201 being screwed to the inner body 200 it could instead be clipped thereto, and it could be formed in separate parts rather than in one piece. It can provide suitable means in its top channel for locking the spout in place in its inoperative state.

A still further embodiment a container of the invention, again in the form of a petrol can, is shown in FIGS. 22 to 25. The can is of similar form to the one previously described with reference to FIGS. 18 and 19, in that it is made up of an inner body 300 and a protective outer body 301. However here the preferably blow moulded body 300 itself has an aperature 302 therethrough to define a rear handle of the can. The body 301 does not extend along the rear of the body 300, but extends only over the upper and front surfaces thereof. An aperture 303 through the upper part of the body 301 defines an upper handle of the can. The body 301 can be screwed to the body 300, as at 304, or clipped or otherwise secured in place.

With this arrangement the push button arrangement is the same as previously described with a cap 305 being removably securable over the push button itself and attached to the body 300. A spout 306 extends from an outlet opening provided by a boss at the front of the body 300 and extending through the body 301, the spout, in its inoperative state, being received in an upwardly open channel 307 at the top of the body 301 and preferably 'locked' in place by respective interengaging ribs and grooves (not shown) or by other suitable means. A cap 308 secured to body 301 is removably fitted to the end of the spout. A boss 309 extends upwardly from the body at the rear thereof and at one side of the body 301. A capture sealing cap 310 is removably engaged with the boss 309. The body 301 is preferably of plastics material.

The can of FIGS. 22 to 25 is preferably modified from that shown so that the protective body 301 extends down along the front of the body 300, in the same manner as for body 201 with body 200 in the previous embodiment. Accordingly the rear handle will be incorporated in the rear part of the protective body instead of being formed in body 300. Again the body 301 will be screwed or otherwise secured to the body 300, as shown with the bodies 200 and 201. With this modified version of the can of FIGS. 22 to 25, the filling boss and cap will be moved forward from the position thereof shown in FIGS. 22 and 23 to the equivalent position shown in FIGS. 18 and 19.

In another form of the invention, the container could be in the form of two of any of the embodiments of can described with respective flat sides thereof being secured together in contact so as to provide a single can which has two separate liquid containing compartments, each having its own filling opening, dispensing opening with spout, and push button arrangement. The can could instead be formed integrally with the two compartments, instead of two cans being secured side-by-side.

The invention claimed is:

1. A container for storing liquid and/or dispensing liquid therefrom, in use, the container having a body with an inlet for the entry of liquid thereinto and an outlet for dispensing liquid therefrom, and a valve associated with the outlet to control the flow of liquid therethrough, the valve having a movable valve member, movement of which is controlled by an actuator operable at the exterior of the body, the body defining a sealed enclosure when the inlet is closed and said actuator is in its non-operative position, and wherein:

in said non-operative position, the actuator seals within the body;

the actuator seals with a housing which is itself sealingly attached to the body at an opening in the wall thereof;

in its operative state the actuator is positioned relative to said housing to vent the container;

said venting is provided by one or more grooves in said actuator allowing air flow past a part of the housing with which the actuator seals in its non-operative position;

venting air flows from the housing into the interior of the body through an opening in the housing; and, the housing contains biasing means to bias the actuator to its non-operative position.

2. A container as claimed in claim 1, wherein the housing contains biasing means to bias the actuator to its non-operative position.

3. A container as claimed in claim 1, wherein a flange surrounds said opening in the wall of the body and a closure member is removably engageable with said flange to prevent inadvertent operation of said actuation, in use.

4. A container as claimed in claim 3, wherein the flange hast at least one opening therein to allow venting of the container even if an open outer end of the flange is covered whilst the actuator is in its operative state.

5. A container as claimed in claim 1, wherein the valve member seals with a valve seat at said outlet when the actuator is in its non-operative position.

6. A container as claimed in claim 1, wherein said inlet is provided by a hollow boss extending from a part of the body which is uppermost, in use, the boss being sealed against outflow of liquid therethrough by a closure member releasably engageable with the boss.

7. A container as claimed in claim 6, wherein the closure member is a cap screw-threadedly engageable with the boss.

8. A container as claimed in claim 3, wherein the closure member is secured to the body by a strap.

9. A container as claimed in claim 1, in which said body is of one-piece construction.

10. A container as claimed in claim 9, in which the body is of plastics materials and formed by blow moulding.

11. A container as claimed claim 1, wherein the body is formed of an inner part and an outer part secured thereto, the outer part defining at least one handle.

12. A container as claimed in claim 11, wherein the outer body part extends centrally longitudinally of said inner part of the body over at least a front part and a top part of the inner body.

13. A container as claimed in claim 12, wherein the outer body part extends over the front, rear and top parts of the inner body, with rear and top handles being defined in rear and top parts respectively of the outer body.

14. A container as claimed in claim 12, wherein the inlet opening is offset relative to said longitudinal centrally extending outer body part and thus to the combination of said actuator and valve which are disposed centrally longitudinally of the body.

15. A pair of containers as claimed in claim 1, joined together side-by-side.

16. A pair of containers as claimed in claim 15, where the joining is integral.

17. A pair of containers as claimed in claim 15, where the joining is non-integral.

* * * * *